US010243303B2

(12) United States Patent
Wei

(10) Patent No.: US 10,243,303 B2
(45) Date of Patent: Mar. 26, 2019

(54) PLUG CONNECTOR WITH GROUND TERMINALS IN CONTACT WITH METAL SHELL

(71) Applicant: LOTES CO., LTD, Keelung (TW)

(72) Inventor: Xin Zheng Wei, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/805,270

(22) Filed: Nov. 7, 2017

(65) Prior Publication Data

US 2018/0145458 A1 May 24, 2018

(30) Foreign Application Priority Data

Nov. 23, 2016 (CN) ..... 2016 2 1258379 U

(51) Int. Cl.

| | |
|---|---|
| ***H01R 13/627*** | (2006.01) |
| ***H01R 13/6581*** | (2011.01) |
| ***H01R 13/428*** | (2006.01) |
| ***H01R 13/66*** | (2006.01) |
| ***H01R 13/6597*** | (2011.01) |
| ***H01R 31/08*** | (2006.01) |
| *H01R 4/02* | (2006.01) |
| *H01R 24/60* | (2011.01) |

(52) U.S. Cl.

CPC ..... *H01R 13/6581* (2013.01); *H01R 13/428* (2013.01); *H01R 13/6273* (2013.01); *H01R 13/6597* (2013.01); *H01R 13/6683* (2013.01); *H01R 31/08* (2013.01); *H01R 4/023* (2013.01); *H01R 24/60* (2013.01)

(58) Field of Classification Search

CPC ..... H01R 4/64; H01R 23/688; H01R 4/646; H01R 13/6275; H01R 23/6873; H01R 13/658; H01R 23/7073

USPC ... 439/92, 98, 101, 108, 350, 607.35, 607.4, 439/607.45, 607.55, 660

See application file for complete search history.

(56) References Cited

U.S. PATENT DOCUMENTS 6,056,578 A * 5/2000 Lin ..... H01R 13/514 439/358
6,799,986 B2 * 10/2004 Igarashi ..... H01R 13/6275 439/358

(Continued)

FOREIGN PATENT DOCUMENTS

CN 205051084 U 2/2016

*Primary Examiner* — Thanh Tam T Le
(74) *Attorney, Agent, or Firm* — Locke Lord LLP; Tim Tingkang Xia, Esq.

(57) ABSTRACT

A plug connector includes a metal shell, an insulating body retained in the metal shell and having a mating portion, multiple terminals, and at least one grounding elastic piece. The mating portion is recessed from front to back to form a mating slot. The terminals include contacting portions arranged in a row on upper and lower opposite sides of the mating slot. The terminals include at least one ground terminal formed by blanking a sheet metal. The plate surface of the ground terminal is arranged vertically. The grounding elastic piece is formed by blanking a sheet metal. The plate surface of the grounding elastic piece is arranged in parallel to the plate surface of the ground terminal, and the two are connected electrically to each other. A conducting portion is formed on the cutting surface of the grounding elastic piece, and in contact with the metal shell.

29 Claims, 11 Drawing Sheets

(56) References Cited

U.S. PATENT DOCUMENTS

| | | | | |
|---|---|---|---|---|
| 7,413,467 | B1 * | 8/2008 | Lai | H01R 13/641 439/489 |
| 7,607,947 | B1 * | 10/2009 | Ho | H01R 12/707 439/108 |
| 8,062,050 | B2 * | 11/2011 | Wu | H01R 13/6582 439/350 |
| 8,556,648 | B2 * | 10/2013 | Wu | H01R 13/5213 439/276 |
| 8,597,060 | B2 * | 12/2013 | Wu | H01R 13/6471 439/660 |
| 8,662,933 | B2 * | 3/2014 | Wu | H01R 13/6585 439/660 |
| 8,747,147 | B2 * | 6/2014 | Yu | H01R 13/7031 439/108 |
| 8,814,599 | B2 * | 8/2014 | Wu | H01R 13/5808 439/607.48 |
| 9,281,626 | B2 * | 3/2016 | Lin | H01R 13/6581 |
| 9,397,433 | B2 * | 7/2016 | Kao | H01R 13/658 |
| 9,425,565 | B1 * | 8/2016 | Chien | H01R 12/707 |
| 9,728,885 | B2 * | 8/2017 | Yokoyama | H01R 13/42 |

* cited by examiner

100

PLUG CONNECTOR WITH GROUND TERMINALS IN CONTACT WITH METAL SHELL

CROSS-REFERENCE TO RELATED APPLICATIONS

This non-provisional application claims priority to and benefit of, under 35 U.S.C. § 119(a), Patent Application No. 201621258379.7 filed in P.R. China on Nov. 23, 2016, the entire content of which is hereby incorporated by reference.

FIELD OF THE INVENTION

The invention relates to a plug connector, and more particularly to a plug connector which realizes the mutual grounding of ground terminals and a metal shell.

BACKGROUND OF THE INVENTION

A conventional plug connector includes an insulating body, multiple terminals arranged on the insulating body, and a metal shell sleeved outside the insulating body. The insulating body has a base and a mating portion located at the front of the base. The front end surface of the mating portion is recessed backward to form a mating slot in which a tongue of a socket connector can be inserted therein. The mating portion has a top plate located over the mating slot, a bottom plate located under the mating slot, and two side plates located by both sides of the mating slot. The insulating body is provided with multiple terminal slots. The terminal slots extend from the base to the top plate and the bottom plate. The multiple terminals are provided with multiple contacting portions which are respectively arranged in a row on the top plate and the bottom plate. The multiple terminals include multiple ground terminals. Each ground terminal is formed in the form of a sheet metal, and has a fixing portion for being retained in the terminal slot and at least one contacting arm extending forward from the fixing portion. Each contacting arm has a contacting portion extending into the mating slot. Each ground terminal also has a connecting portion bending from the upper side of the fixing portion and extending upward in the horizontal direction. The connecting portion and the fixing portion are arranged approximately at a right angle. An elastic arm is formed by extending forward from the extending end of the connecting portion and in the longitudinal direction. An outwardly raised arc-shaped conducting plane is formed on the plate surface of the elastic arm to be in contact with the metal shell.

In the plug connector with the above-mentioned structure, since the conducting plane is formed on the plane of the elastic arm to be in contact with the metal shell, although the elasticity of the elastic arm is good, the normal force of the elastic arm is little, and as a result, the poor contact between the conducting plane and the metal shell can be caused easily. Moreover, because the elastic arm can be fatigued easily, in the process of long-term urging contact between the elastic arm and the metal shell, the poor contact between the conducting plane and the metal shell or no contact between both can be caused easily to cause the grounded circuit between both to be cut off. In addition, because the grounding elastic piece is bent from the upper side of the fixing portion, bending needs to be performed multiple times, moreover, the arc-shaped conducting plane formed on the grounding elastic piece also requires stamping, so the stamping process is complex.

Therefore, a heretofore unaddressed need exists in the art to address the aforementioned deficiencies and inadequacies.

SUMMARY OF THE INVENTION

In one aspect, the present invention relates to a plug connector which can realize mutual grounding of ground terminals and a metal shell and a great normal contact force between both and is simple in manufacturing.

In certain embodiments, a plug connector includes a metal shell, an insulating body accommodated in the metal shell, multiple terminals, and at least one grounding elastic piece. The front end of the insulating body is provided with a mating portion, and the mating portion is recessed from front to back, so as to form a mating slot. The terminals are provided with multiple contacting portions. The contacting portions are respectively arranged in a row on the upper and lower opposite sides of the mating slot. The terminals include at least one ground terminal. The ground terminal is formed by blanking a sheet metal. The plate surface of the ground terminal is arranged vertically. The at least one grounding elastic piece is formed by blanking a sheet metal. The plate surface of the grounding elastic piece and the plate surface of the ground terminal are located within the same vertical plane and are connected electrically to each other, and a conducting portion which is formed on the section of the grounding elastic piece is in contact with the metal shell in the vertical direction to form grounding.

In certain embodiments, the insulating body is provided with multiple terminal slots for correspondingly accommodating the terminals. The ground terminal has a fixing portion and a first tail portion extending backward from the fixing portion. The fixing portion is fixed in the terminal slot. The grounding elastic piece is formed by extending out of the insulating body from one of the upper and lower opposite sides of the first tail portion.

In certain embodiments, the grounding elastic piece is provided with a vertical arm connected to the first tail portion and a horizontal arm formed by extending forward from the first vertical arm. The outwardly projected arc-shaped conducting portion that is formed on the section of the horizontal arm is in contact with the internal wall surface of the metal shell.

In certain embodiments, the insulating body is provided with a limiting slot for retaining the horizontal arm. A partition is arranged between the limiting slot and one of the terminal slots to limit the horizontal arm from excessive deformation, and the limiting slot and the one of the terminal slots communicate with each other in the vertical direction at the rear end position of the insulating body.

In certain embodiments, at least one of the upper and lower opposite sides of the fixing portion is provided with a protruding portion which is in interference fit with the terminal slot, and the protruding portion is located in front of the horizontal arm.

In certain embodiments, the first tail portion is suspended in the terminal slot.

In certain embodiments, the plug connector further includes a latch member. The latch member has a connecting portion and two locking arms located at both sides of the connecting portion and connected electrically to the connecting portion. The two locking arms are located on both sides of the mating portion and respectively provided with a locking portion which extends into the mating slot to engage with a buckling slot of a tongue.

In certain embodiments, the first tail portion is provided with an opening recessed forward from the rear edge of the first tail portion. Two clamping arms are respectively formed on the upper and lower sides of the opening of the first tail portion to elastically urge against the connecting portion in the vertical direction.

In certain embodiments, each clamping arm is provided with a protrusion which is projected into the opening to urge against the connecting portion.

In certain embodiments, the first tail portion is provided with an opening recessed forward from the rear edge of the first tail portion and running through the upper edge or lower edge of the first tail portion, and the first tail portion elastically urges against the connecting portion in the vertical direction.

In certain embodiments, there are two ground terminals which are arranged symmetrically on the left-right direction of the insulating body. Each ground terminal is provided with two contacting arms extending forward from the fixing portion, and the two contacting arms are provided with two contacting portions which are aligned in the vertical direction and arranged on the upper and lower opposite sides of the mating slot.

In certain embodiments, a first soldering portion that extends from the connecting portion is exposed out of the rear end of the insulating body and used for being soldered with a ground wire, and the first tail portion is connected electrically to the ground wire through the first soldering portion.

In certain embodiments, the locking arms and the first soldering portion are located within the same plane.

In certain embodiments, the terminals include at least one power terminal and a detecting terminal. The power terminal is provided with a second soldering portion exposed out of the rear end of the insulating body, the detecting terminal is provided with a third soldering portion exposed out of the rear end of the insulating body, and the first, second and third soldering portions are located within planes at different heights in the vertical direction.

In certain embodiments, the terminals include two power terminals which are arranged symmetrically on the left-right direction. The two power terminals are located between the two ground terminals. Each power terminal is provided with a second tail portion that is suspended in the terminal slot, and the second tail portion extends backward and crosses over the connecting portion, so as to from a second soldering portion.

In certain embodiments, both sides of the mating portion are respectively provided with an open slot to retain the locking arm, and two protruding ribs are respectively arranged convexly above and below each open slot on the outer surface of the mating portion to be in interference fit with the metal shell.

In another aspect, the present invention relates to a plug connector. In certain embodiments, the plug connector includes a metal shell, an insulating body accommodated in the metal shell, multiple terminals and at least one grounding elastic piece. The front end of the insulating body is provided with a mating portion, and the mating portion recesses backward to form a mating slot. The terminals have multiple contacting portions. The multiple contacting portions are respectively arranged in a row on the upper and lower opposite sides of the mating slot. The multiple terminals include at least one ground terminal. The ground terminal is formed by blanking a sheet metal. The plate surface of the ground terminal is arranged vertically. The at least one grounding elastic piece is formed by blanking a sheet metal. The plate surface of the grounding elastic piece is arranged in parallel to the plate surface of the ground terminal and the plate surfaces of the grounding elastic piece and the ground terminal are connected electrically to each other. A conducting portion is formed on the section of the grounding elastic piece and is in contact with the metal shell in the vertical direction to form grounding.

In certain embodiments, the insulating body is provided with multiple terminal slots for correspondingly receiving the multiple terminals. The ground terminal has a fixing portion and a first tail portion extending backward from the fixing portion. The fixing portion is fixed in the terminal slot. The grounding elastic piece is connected electrically to the ground terminal at the first tail portion.

In certain embodiments, the grounding elastic piece is formed by extending out of the insulating body from one of the upper and lower opposite sides of the first tail portion, and the plate surface of the grounding elastic piece and the plate surface of the ground terminal are located within the same vertical plane.

In certain embodiments, a bending portion is connected between the grounding elastic piece and the first tail portion. The bending portion makes the plate surface of the grounding elastic piece and the plate surface of the ground terminal be located within different vertical planes.

In certain embodiments, the first tail portion is suspended in the terminal slot.

In certain embodiments, the plug connector further includes a latch member. The latch member has a connecting portion and two locking arms located at both sides of the connecting portion and connected electrically to the connecting portion. The two locking arms are located on both sides of the mating portion and respectively provided with a locking portion which extends into the mating slot to engage with a buckling slot of a tongue.

In certain embodiments, the first tail portion is provided with an opening recessed forward from the rear edge of the first tail portion. Two clamping arms are respectively formed on the upper and lower sides of the opening of the first tail portion to elastically urge against the connecting portion in the vertical direction.

In certain embodiments, each clamping arm is provided with a protrusion which is projected into the opening to urge against the connecting portion.

In certain embodiments, the first tail portion is provided with an opening recessed forward from the rear edge of the first tail portion and running through the upper edge or lower edge of the first tail portion, and the first tail portion elastically urges against the connecting portion in the vertical direction.

In certain embodiments, there are two ground terminals which are arranged symmetrically on the left and right of the insulating body. Each ground terminal is provided with two contacting arms extending forward from the fixing portion, and the two contacting arms are provided with two contacting portions which are aligned in the vertical direction and arranged on the upper and lower opposite sides of the mating slot.

In certain embodiments, a first soldering portion that extends from the connecting portion is exposed out of the rear end of the insulating body and used for being soldered with a ground wire, and the first tail portion is connected electrically to the ground wire through the first soldering portion.

In certain embodiments, the locking arms and the first soldering portion are located within the same plane.

In certain embodiments, the terminals include at least one power terminal and a detecting terminal. The power terminal is provided with a second soldering portion exposed out of the rear end of the insulating body, the detecting terminal is provided with a third soldering portion exposed out of the rear end of the insulating body, and the first, second and third soldering portions are located within planes at different heights in the vertical direction.

In certain embodiments, the terminals include two power terminals which are arranged symmetrically on the left-right direction. The two power terminals are located between the two ground terminals. Each power terminal is provided with a second tail portion that is suspended in the terminal slot, and the second tail portion extends backward and crosses over the connecting portion, so as to form a second soldering portion.

In certain embodiments, both sides of the mating portion are respectively provided with an open slot to retain the locking arm, and two protruding ribs are respectively arranged convexly above and below each open slot on the outer surface of the mating portion to be in interference fit with the metal shell.

Compared with the related art, the plate surface of the grounding elastic piece and the plate surface of the ground terminal according to certain embodiments of the present invention are located within the same vertical plane, and thus, the grounding elastic piece and the ground terminal can be formed simply by blanking a sheet metal, thereby reducing cost. In other embodiments, the plate surface of the grounding elastic piece and the plate surface of the ground terminal in the present invention are located within different parallel vertical planes, and thus, the grounding elastic piece and the ground terminal can be formed simply by first blanking a sheet metal and then forming the bending portions, thereby reducing the forming processes for the grounding elastic pieces and the ground terminals. In addition, since the conducting portion is formed on the section of the grounding elastic piece, the grounding elastic piece has a great normal force, preventing the grounding elastic piece from excessive deformation or elastic fatigue, so that the grounding elastic piece and the metal shell are in tight contact, thereby ensuring that a good grounded circuit can be formed between the ground terminals and the metal shell.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
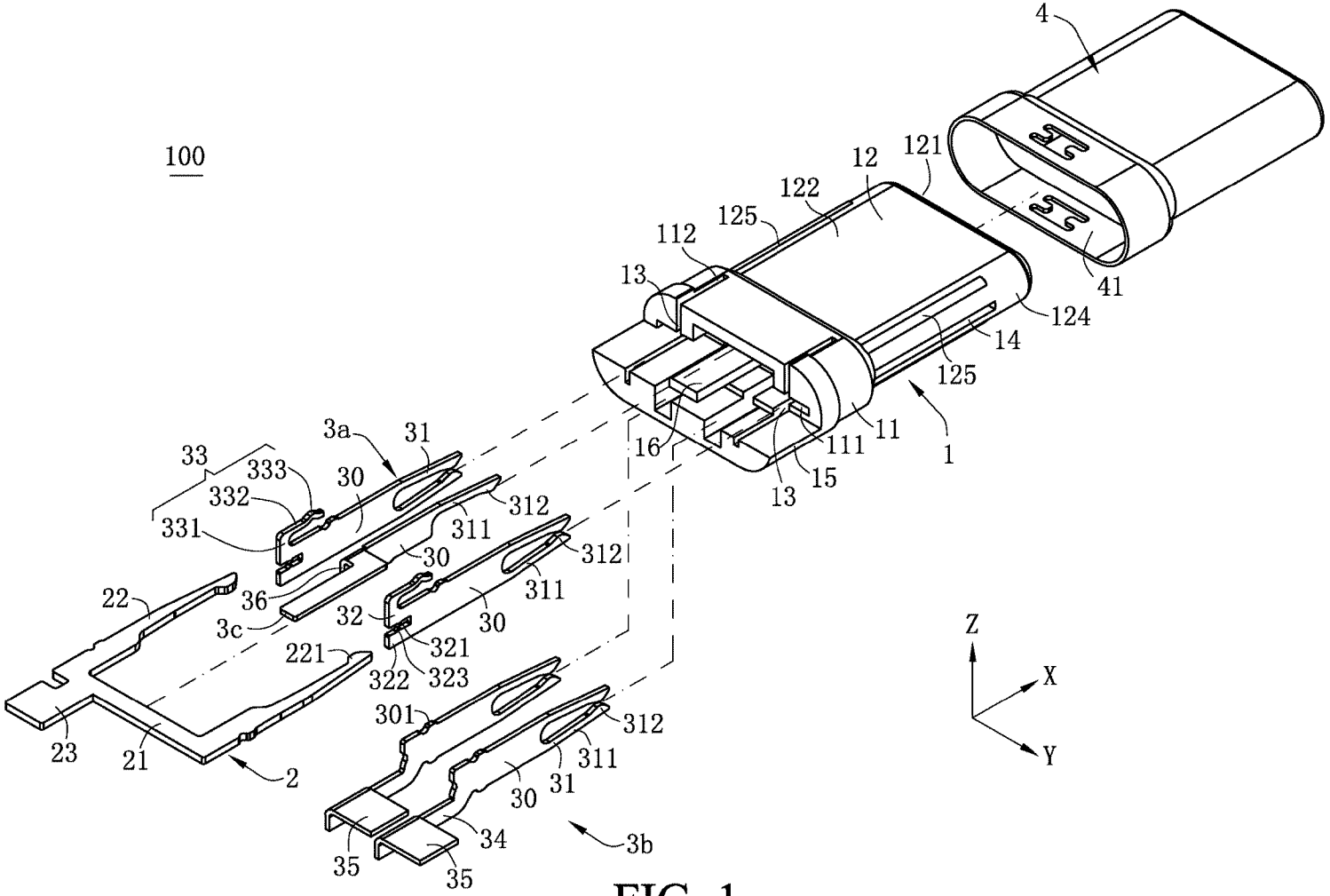
FIG. 1 schematic is a three-dimensional exploded view of a first embodiment of a plug connector of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to a plug connector.

Figure 3:
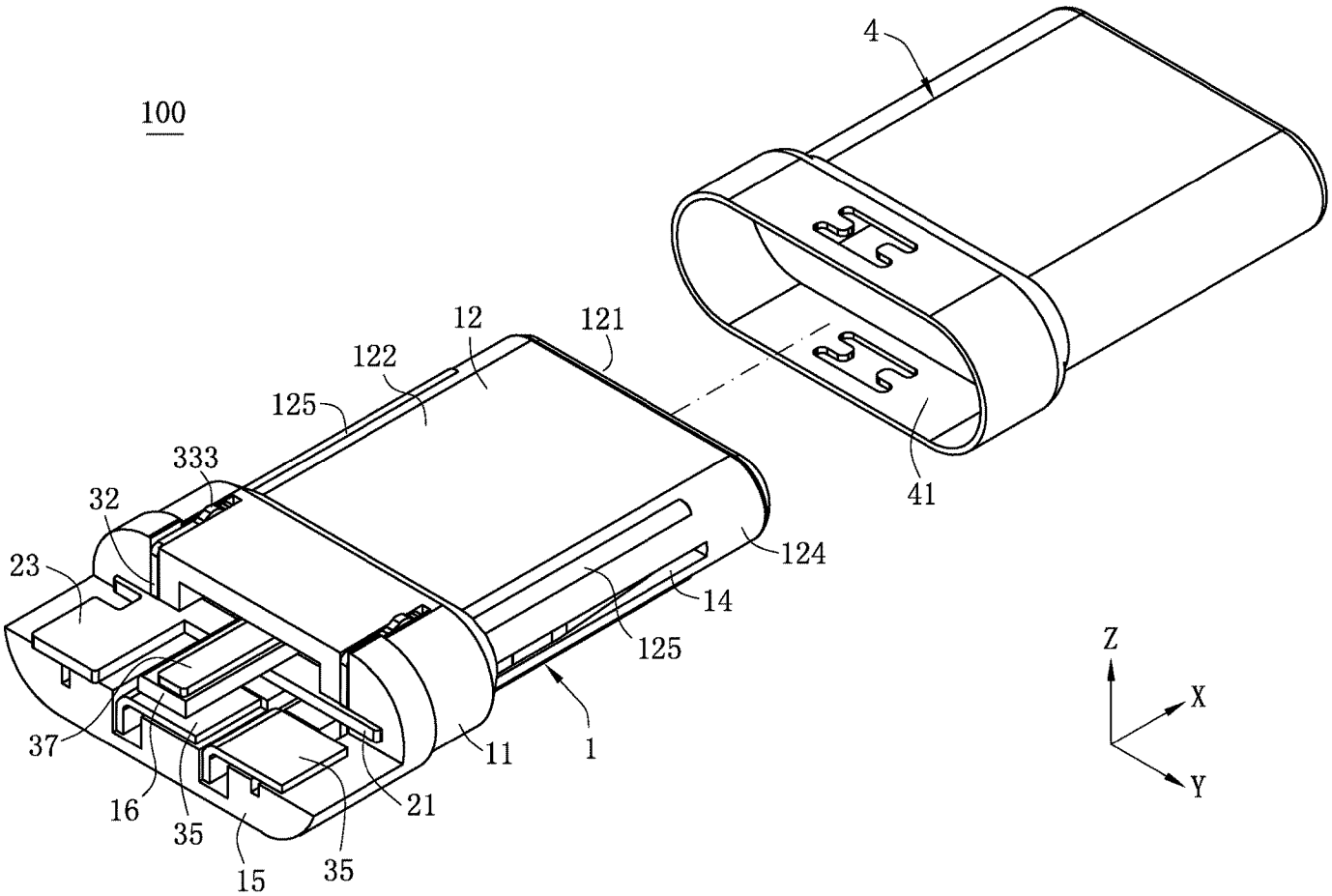
FIG. 3 is a schematic three-dimensional view of the terminals and the latch member assembled on an insulating body in FIG. 2.
Figure 4:
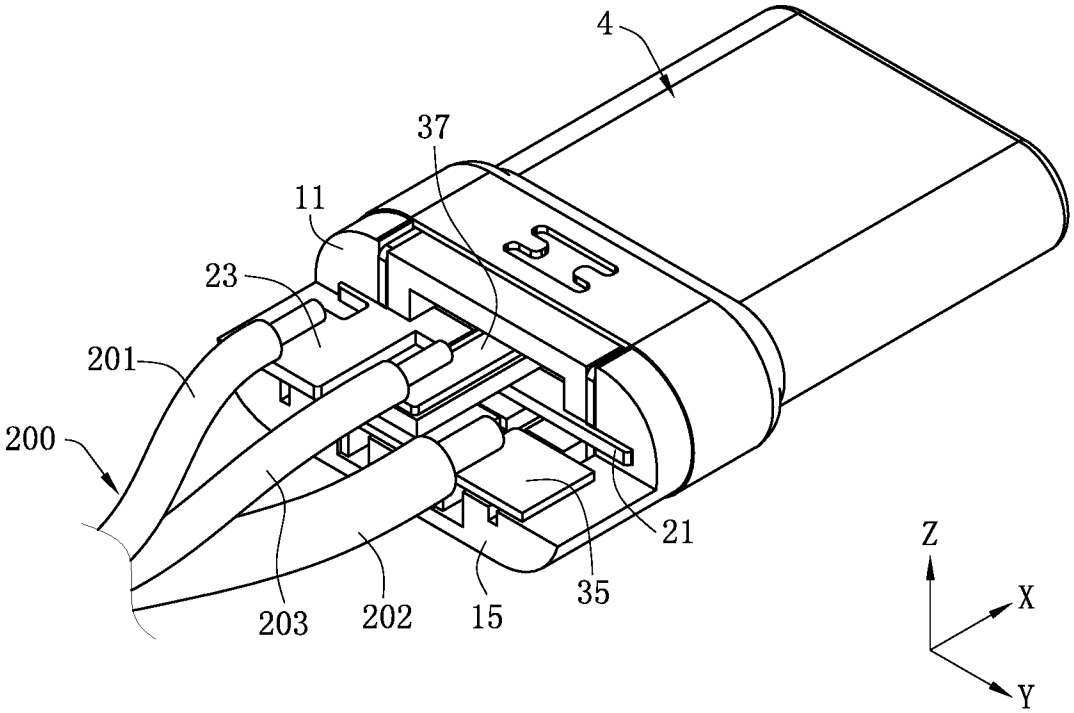
FIG. 4 is a schematic three-dimensional view of the soldering of the terminals and the latch member on a cable after the insulating body assembled in a metal shell in FIG. 3.

Referring to FIGS. 1, 3 and 4, a plug connector 100 of a first embodiment of the present invention includes an insulating body 1, a latch member 2 arranged on the insulating body 1, multiple terminals 3 arranged on the insulating body 1, and a metal shell 4 sleeving the insulating body 1. The plug connector 100 is used for being connected to a cable 200. The cable 200 includes a ground wire 201, a power wire 202, and a detecting wire 203. For convenience of better understanding, the accompanying drawings of the present invention adopt a three-dimensional coordinate system, where X represents forward direction, Y represents rightward direction, and Z represents upward direction.

Figure 2:
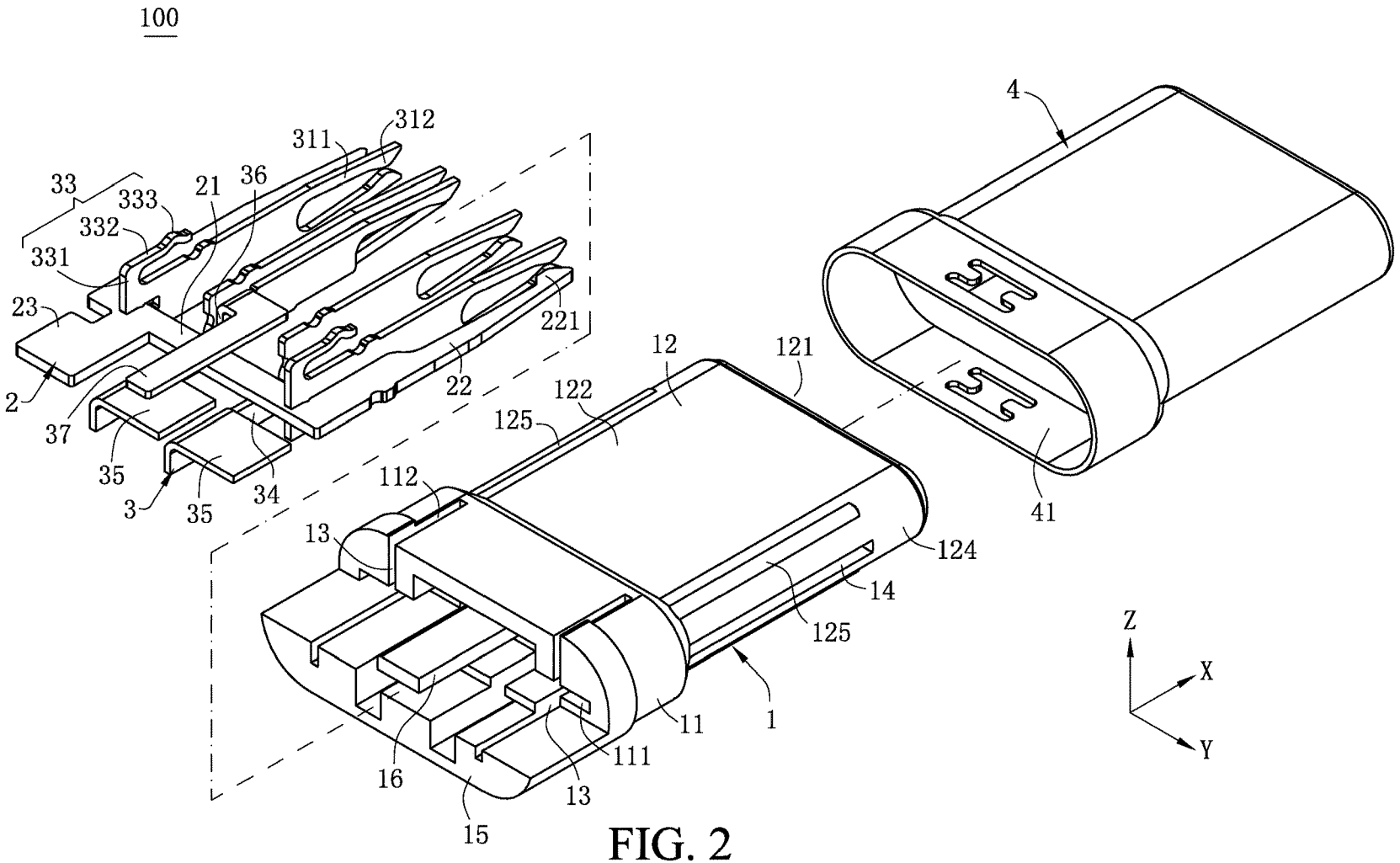
FIG. 2 is a schematic three-dimensional view of the relative position relationship between terminals and a latch member of FIG. 1.
Figure 9:
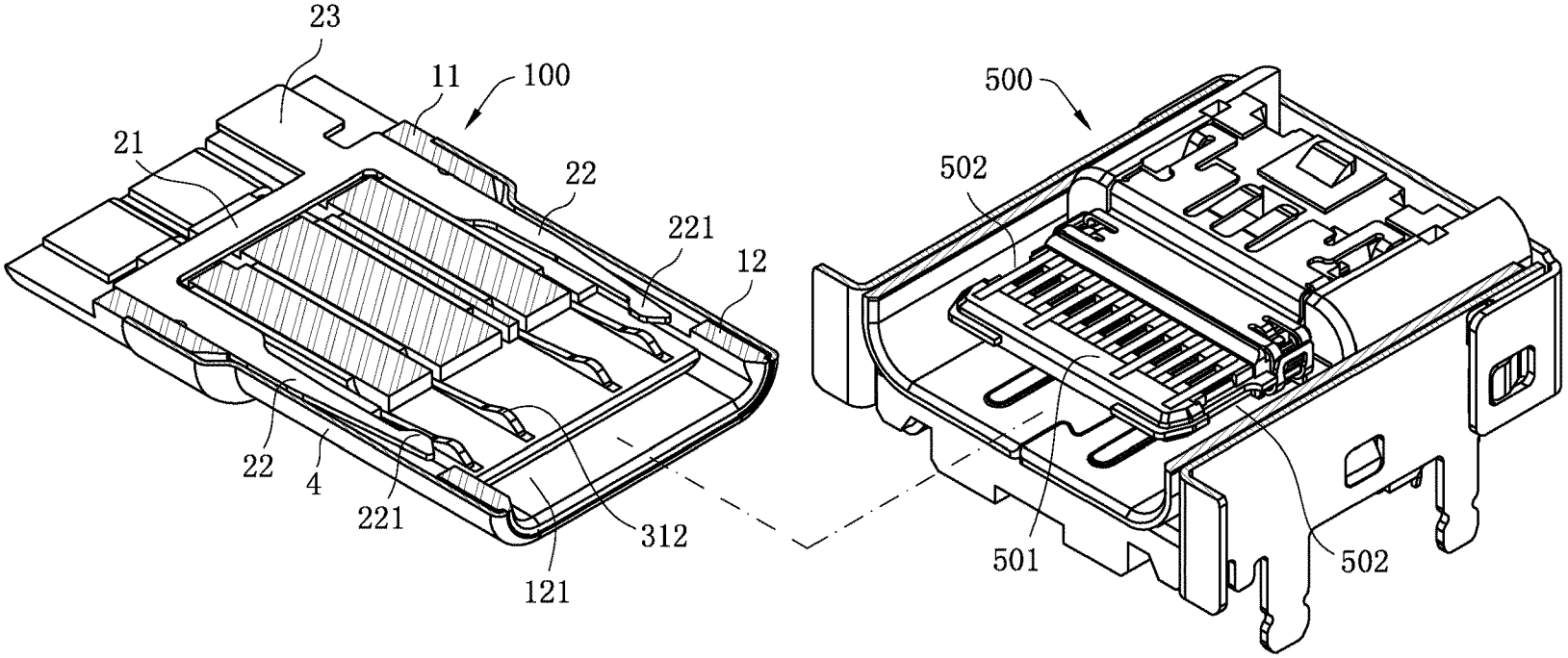
FIG. 9 is a three-dimensional section view of a plug connector and a mating socket connector.

Referring to FIG. 1, FIG. 2 and FIG. 9, the insulating body 1 has a base 11 and a mating portion 12 extending forward from the base 11. The rear end surface of the base 11 is recessed forward to form a clamping slot 111. The clamping slot 111 is located in the middle of the base 11 in the vertical direction. Two limiting slots 112 are respectively arranged concavely in the upper surface of the base 11 on both sides of the base 11. The mating portion 12 is provided with a front end surface (not shown), a mating slot 121 recessed backward from the front end surface, a top plate 122 located over the mating slot 121, a bottom plate 123 located under the mating slot 121, and two side plates 124 located by both sides of the mating slot 121. A tongue 501 of a socket connector 500 can be inserted into the mating slot 121 in dual orientation. The insulating body 1 has multiple terminal slots 13 and two open slots 14. The terminal slots 13 extend to the top plate 122 and the bottom plate 123 from the base 11. Moreover, the two outermost terminal slots 13 are provided with a partition 113 at a location of the base 11 corresponding to the limiting slot 112. The limiting slots 112 and the terminal slots 13 of the corresponding sides communicate with each other at the rear end position of the base 11 in the vertical direction, and running upward through the upper surface of the base 11. The two open slots 14 are respectively located in both sides of the insulating body 1. The open slots 14 extend to the side plates 124 from the base 11, and respectively communicate with the mating slot 121 and the clamping slot 111. Two protruding ribs 125 are respectively arranged convexly above and below each open slot 14 on the outer surface of the mating portion 12. The insulating body 1 is also provided with a soldering plate 15 formed by extending backward from the lower side of the rear end of the base 11 and a supporting plate 16 extending backward from the rear end of the base 11 and located above the soldering plate 15. The supporting plate 16 and the soldering plate 15 are arranged separately, and the supporting plate 16 is located approximately at the middle position of the insulating body 1 in the horizontal direction.

Referring to FIGS. 1, 4, 5A and 5B, the latch member 2 has a connecting portion 21 and two locking arms 22 located at both sides of the connecting portion 21 and connected electrically to the connecting portion 21. In the present embodiment, the latch member 2 is formed by blanking a sheet metal. That is, the connecting portion 21 and the locking arms 22 are integrally formed, and are both located within the same horizontal plane. The connecting portion 21 extends in the horizontal direction, and is retained in the clamping slot 111. The locking arms 22 are respectively arranged in the open slots 14 and each provided with a locking portion 221 extending into the mating slot 121. The locking portions 221 are used for engaging with a buckling slot 502 of the tongue 501 (as shown in FIG. 9). The latch member 2 is has a first soldering portion 23 connected to the connecting portion 21 behind the connecting portion 21. The first soldering portion 23 is arranged at one end of the connecting portion 21. Moreover, the first soldering portion 23 is supported above the soldering plate 15. The locking arms 22 and the first soldering portion 23 are located within the same plane. An internal conductor (not shown) of the ground wire 201 is arranged on the first soldering portion 23 and the two are soldered to form electric connection.

Referring to FIG. 1, the terminals 3 are respectively accommodated in the terminal slots 13. The terminals 3 include multiple ground terminals 3*a*, multiple power terminals 3*b*, and a detecting terminal 3*c*. The terminals 3 are made by blanking sheet metals. In the present embodiment, the plug connector 100 is of a simple version of universal serial bus (USB) Type-C structure. There are two ground terminals 3*a*, two power terminals 3*b*, and one detecting terminal 3*c*. Both the ground terminals 3*a* and the power terminals 3*b* are terminals with a tuning fork type structure. Moreover, the two ground terminals 3*a* and the two power terminals 3*b* are arranged symmetrically on the left-right direction in the insulating body 1.

Referring to FIGS. 1, 2, 5A and 5B, each terminal 3 has a fixing portion 30 retained in the terminal slot 13. The plate surface of the fixing portion 30 is arranged vertically. The fixing portion 30 is provided with at least one protruding portion 301 on at least one of the upper and lower sides, and the protruding portion 301 is in interference fit with the terminal slot 13. The front of the fixing portion 30 extends, so as to form an extending portion 31. The plate surface of the extending portion 31 is also arranged vertically. Each extending portion 31 of the ground terminals 3*a* and the power terminals 3*b* is respectively provided with two contacting arms 311 arranged oppositely in the vertical direction. The two contacting arms 311 are respectively located on the top plate 122 and the bottom plate 123. Each contacting arm 311 extends toward the mating slot 121, a contacting portion 312. The contacting portions 312 of the two contacting arms 311 are aligned in the vertical direction. The extending portion 31 of the detecting terminal 3*c* has only one contacting arm 311 arranged on the top plate 122 or the bottom plate 123.

Referring to FIGS. 1, 5A, 5B and 6, each ground terminal 3*a* has a first tail portion 32 extending backward from the fixing portion 30. The plate surface of the first tail portion 32 is arranged vertically. Thus, the plate surface of the first tail portion 32 and the plate surface of the latch member 2 are perpendicular to each other. The first tail portion 32 is suspended in the terminal slot 13. That is, there is a gap between the first tail portion 32 and the surrounding walls of the terminal slot 13. The first tail portion 32 is provided with an opening 321. The opening 321 is formed by recessing forward from the rear edge of the first tail portion 32. Two clamping arms 322 are respectively formed on the upper and lower sides of the opening 321 of the first tail portion 32. The clamping arms 322 have elasticity. Each clamping arm 322 is provided with a protrusion 323 projected into the opening 321. The connecting portion 21 is located in the openings 321. The clamping arms 322 elastically urge against the connecting portion 21 in the vertical direction, so that the protrusions 323 are in tight contact with the connecting portion 21, and thereby all the two ground terminals 3*a* and the latch member 2 can keep a good grounded circuit.

Figure 7:
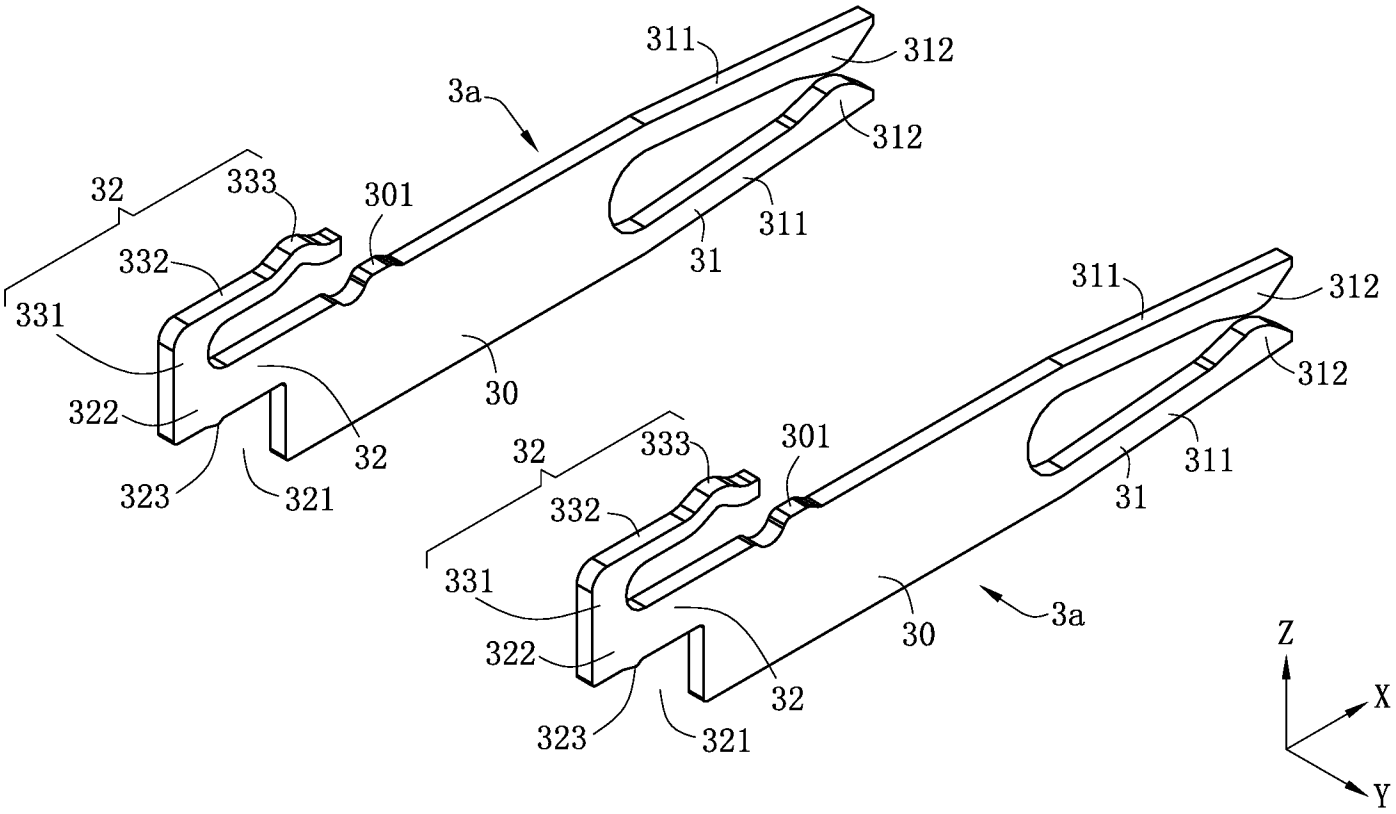
FIG. 7 is a schematic three-dimensional view of another embodiment of two ground terminals arranged symmetrically on the left-right direction.

Referring to FIG. 1 and FIG. 7, in other embodiments, the opening 321 is formed by recessing forward from the rear edge of the first tail portion 32 and running through the upper edge or lower edge of the first tail portion 32. That is, the first tail portion 32 has only one clamping arm 322. Likewise, this clamping arm 322 elastically urges against the connecting portion 21 in the vertical direction, and a good grounded circuit can still be kept between the latch member 2 and the two ground terminals 3*a*.

Figure 5A:
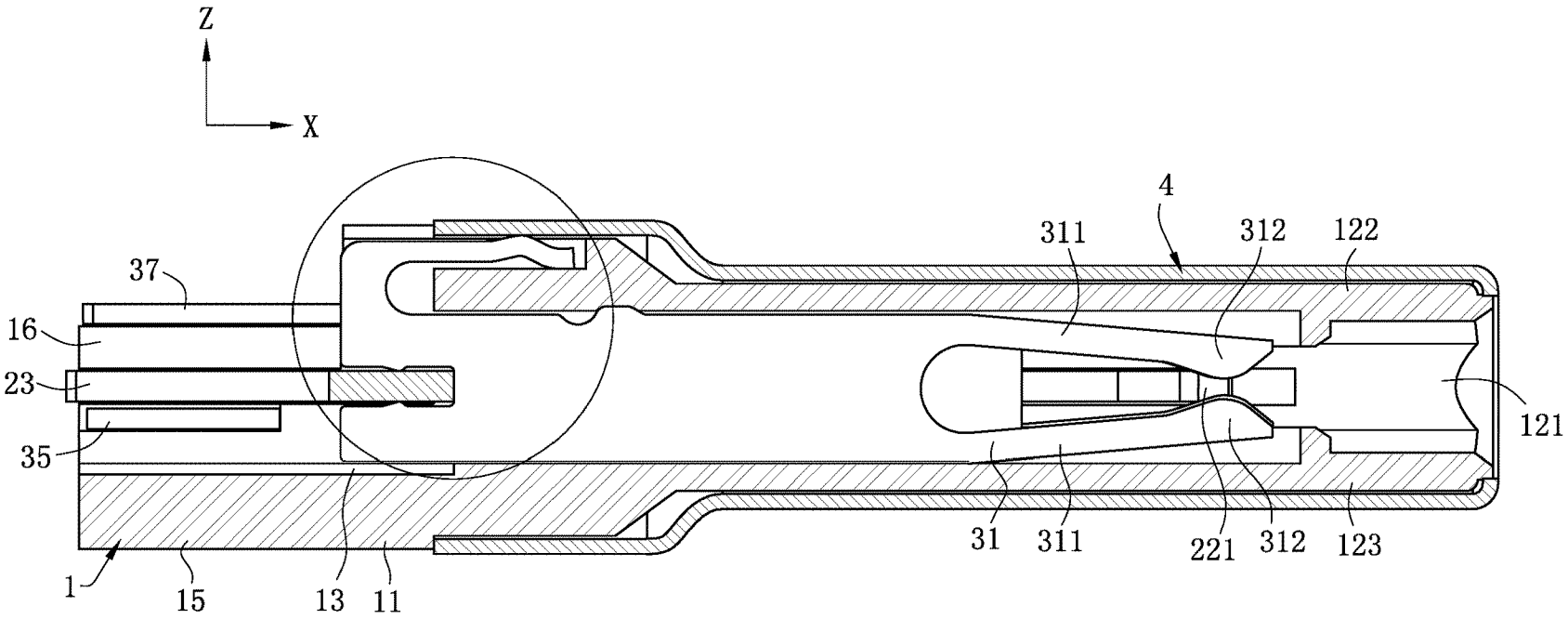
FIG. 5A is a section view after the insulating body is assembled in the metal shell in FIG. 3.
Figure 5B:
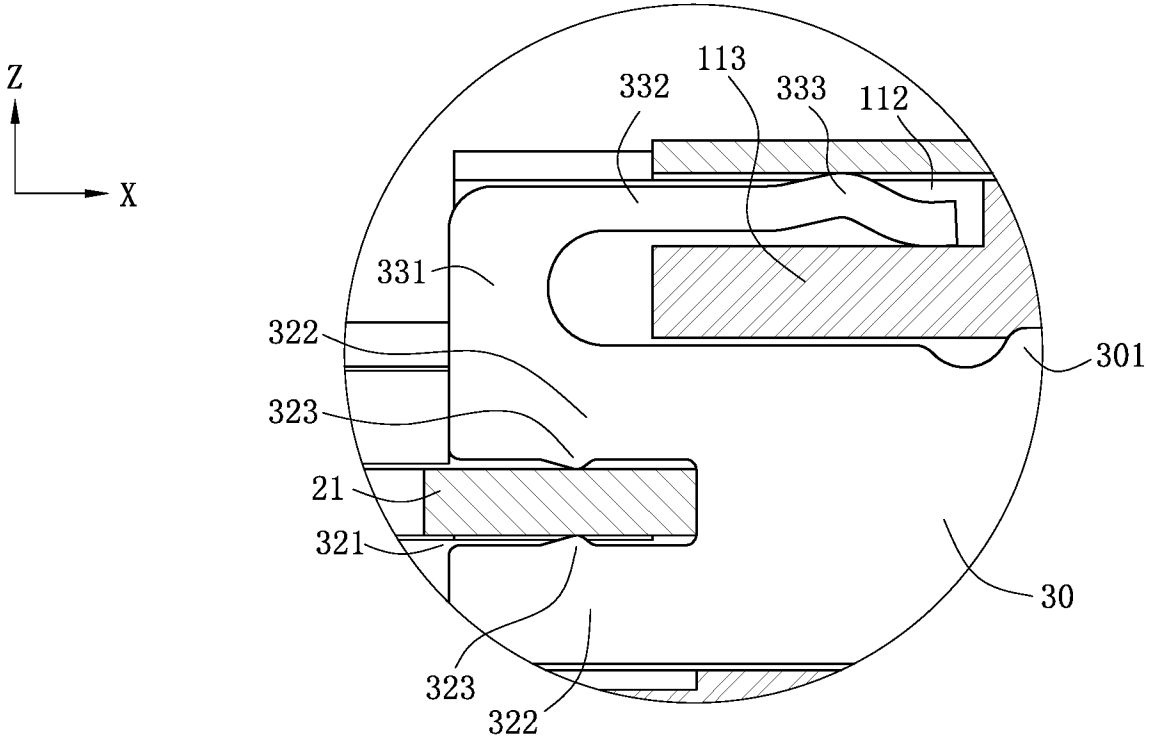
FIG. 5B a local enlarged view of the plug connector in FIG. 5A.

Referring to FIG. 1, FIG. 5A and FIG. 5B, one of the upper and lower opposite sides of the first tail portion 32 extends out of the insulating body 1 in the vertical direction, so as to forma grounding elastic piece 33. The same sheet metal is stamped to form the grounding elastic piece 33 and the ground terminal 3*a*. The plate surface of the grounding elastic piece 33 and the plate surface of the ground terminal 3*a* are arranged in parallel and are connected electrically to each other. In the present embodiment, the plate surface of the grounding elastic piece 33 and the plate surface of the ground terminal 3*a* are located within the same vertical plane. Thus, the grounding elastic piece 33 and the ground terminal 3*a* can be formed simply by a sheet metal blanking and forming process, and the two ground terminals 3*a* are arranged symmetrically on the left-right direction can be produced simply by the same set of die. The grounding elastic piece 33 is provided with a vertical arm 331 connected to one of the clamping arms 322 of the first tail portion 32 and a horizontal arm 332 formed by extending forward from the vertical arm 331. The horizontal arm 332 is retained in the limiting slot 112, and located behind the protruding portion 301 in the longitudinal direction. An outwardly projected arc-shaped conducting portion 333 is formed on the cutting surface of the horizontal arm 332, for contacting the inner wall surface of the metal shell 4. When urging against the metal shell 4, the conducting portions 333 are stressed to deform toward the fixing portions 30. Because the horizontal arms 332 are limited by the partition 113, the excessive deformation or elastic fatigue of the horizontal arms 332 can be prevented, thereby ensuring that a good grounded circuit can be formed between the ground terminals 3*a* and the metal shell 4.

Figure 6:
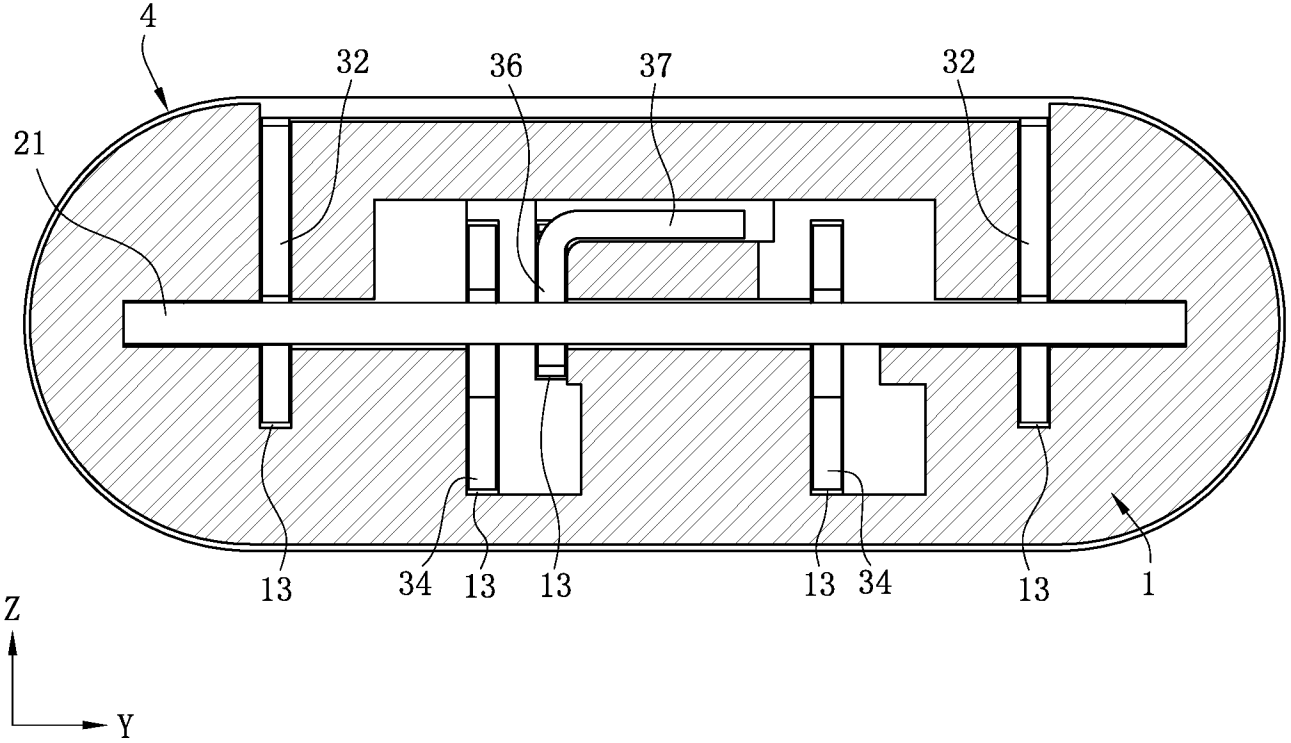
FIG. 6 is another section view after the insulating body is assembled in the metal shell in FIG. 3.

Referring to FIGS. 1, 4 and 6, each power terminal 3*b* has a second tail portion 34 extending backward from the fixing portion 30. The plate surface of the second tail portion 34 is arranged vertically, and the second tail portion 34 is suspended in the terminal slot 13. That is, there is a gap between the second tail portion 34 and the surrounding walls of the terminal slot 13. The second tail portions 34 extend backward and cross over the connecting portion 21. Moreover, the second tail portions 34 of the two power terminals 3*b* are respectively bent toward the same side in the horizontal direction, so as to form a second soldering portion 35. The two power terminals 3*b* are arranged side by side in the horizontal direction. Furthermore, there is a gap (not shown) between the two second soldering portions 35. The power wire 202 is placed over the gap, and is connected electrically to the two second soldering portions 35 through solder (not shown).

Referring to FIGS. 1, 4 and 6, the detecting terminal 3*c* has a third tail portion 36 extending backward from the fixing portion 30. The plate surface of the third tail portion 36 is arranged vertically. The third tail portion 36 is located in front of the connecting portion 21, and suspended in the terminal slot 13. That is, there is a gap between the third tail portion 36 and the surrounding walls of the terminal slot 13. One of the upper and lower opposite sides of the third tail portion 36 is bent and extends backward to cross over the connecting portion 21, so as to form a third soldering portion 37. The third soldering portion 37 is arranged on the supporting plate 16. An internal conductor (not shown) of the detecting wire 203 is arranged correspondingly on the third soldering portion 37. The plate surfaces of the first soldering portion 23, the second soldering portion 35 and the third soldering portion 37 are all arranged horizontally, and are located within planes at different heights.

Referring to FIG. 1 and FIG. 2, the metal shell 4 is of a seamlessly connected tubular structure formed by a drawing and printing process, and is provided with a receiving cavity 41. The insulating body 1 is contained in the receiving cavity 41. The protruding ribs 125 are in interference fit with the metal shell 4, so that the metal shell 4 and the insulating body 1 are tightly immobilized together.

Figure 8A:
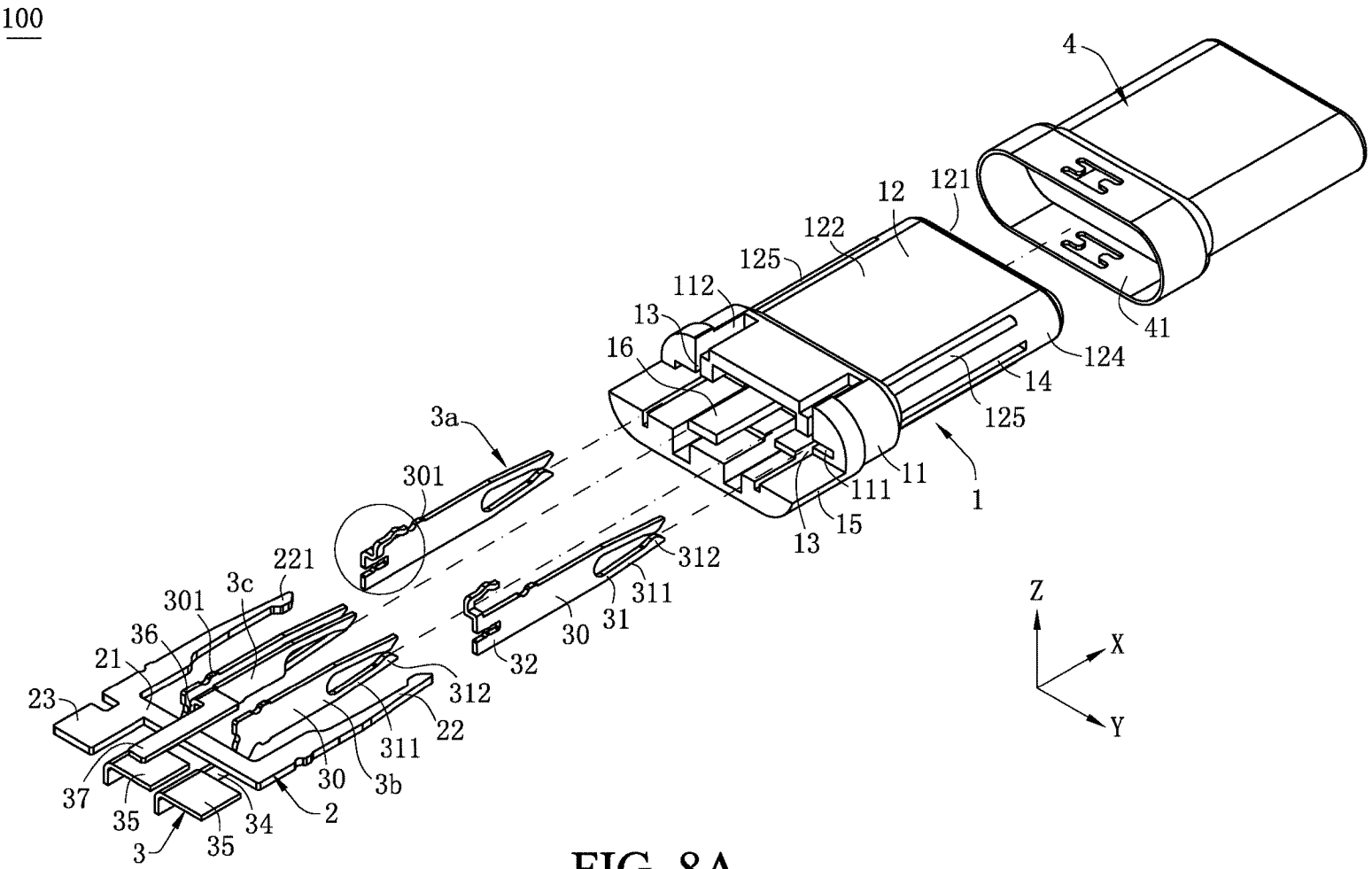
FIG. 8A is a schematic three-dimensional exploded view of a second embodiment of the plug connector of the present invention.
Figure 8B:
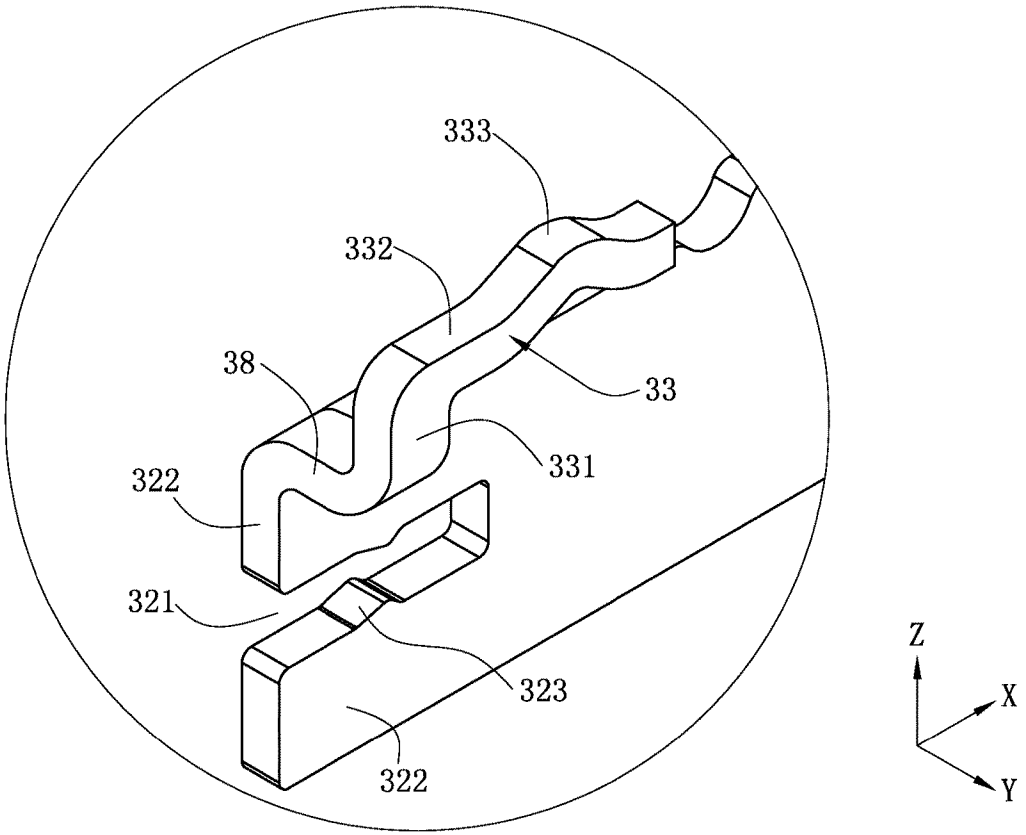
FIG. 8B a local enlarged view of the plug connector in FIG. 8A.

Referring to FIG. 8A and FIG. 8B, a plug connector 100 of the second embodiment of the present invention is provided. The structure of the second embodiment is approximately the same as the structure of the above-mentioned first embodiment. Therefore, the same numerals in the drawings represent the same structures, so the same structures are not described repeated any more. The difference between the structure of the second embodiment and the structure of the first embodiment is as follows: a bending portion 38 is connected between the grounding elastic piece 33 and the first tail portion 32, and the bending portion 38 makes the plate surface of the grounding elastic piece 33 and the plate surface of the ground terminal 3*a* be located within different vertical planes.

In summary, the plug connector according to certain embodiments of the present invention has the following beneficial advantages:

1. The plate surface of the grounding elastic piece 33 and the plate surface of the ground terminal 3*a* are located within the same vertical plane, thus, the grounding elastic piece 33 and the ground terminal 3*a* can be formed simply by blanking a sheet metal. Moreover, the two ground terminals 3*a* which are arranged symmetrically on the left-right direction can be produced simply by the same set of die, thereby reducing cost. Alternatively, the plate surface of the grounding elastic piece 33 and the plate surface of the ground terminal 3*a* are located within different parallel vertical planes. Thus, the grounding elastic piece 33 and the ground terminal 3*a* can be formed simply by first blanking a sheet metal and then forming the bending portions 38. Thereby, compared with the related art, the forming processes for the grounding elastic pieces 33 and the ground terminals 3*a* can be reduced. In addition, since the conducting portion 333 is formed on the cutting surface of the grounding elastic piece 33, the grounding elastic piece 33 has a great normal force, preventing the grounding elastic piece 33 from excessive deformation or elastic fatigue, so that the grounding elastic piece 33 and the metal shell 4 are in tight contact, and thereby it is ensured that a good grounded circuit can be formed between the ground terminals 3*a* and the metal shell 4.

2. The first tail portion 32 is suspended in the terminal slot 13, the vertical arm 331 is connected to one of the clamping arms 322 of the first tail portion 32, the clamping arms 322 have elasticity, and thus, when the conducting portions 333 urge against the metal shell 4, the grounding elastic pieces 33 are stressed to deform toward the fixing portions 30.

Since the horizontal arms 332 are limited by the partition 113, the excessive deformation of the horizontal arms 332 can be prevented, and thereby it is ensured that a good grounded circuit can be formed between the ground terminals 3*a* and the metal shell 4.

3. The clamping arms 322 have elasticity, and elastically urge against the connecting portion 21 or the positioning protruding portion 222 in the vertical direction. Thus, the two ground terminals 3*a* and the latch member 2 can be in tight contact, and thereby a good grounded circuit can be kept between both. Moreover, the first tail portions 32 are suspended in the terminal slots 13, and thus, spaces for deformation can be provided for the clamping arms 322 in the terminal slots 13.

4. Since the first tail portions 32 are suspended in the terminal slots 13 and the fixing portions 30 are located in front of the first tail portions 32, when the clamping arms 322 elastically urge against the connecting portion 21 in the vertical direction, the acting force between both cannot affect the true positions of the ground terminals 3*a*.

5. The plate surfaces of the first soldering portion 23, the second soldering portions 35 and the third soldering portion 37 are all arranged horizontally and located within planes at different heights, such that the ground wire 201, the power wire 202 and the detecting wire 203 can be soldered on the soldering portions by utilizing the effective space of the rear end of the insulating body 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A plug connector, comprising:

a metal shell;

an insulating body accommodated in the metal shell, a front end of the insulating body being provided with a mating portion, and the mating portion being recessed from front to back to form a mating slot;

a plurality of terminals having a plurality of contacting portions, the contacting portions being respectively arranged in a row on upper and lower opposite sides of the mating slot, the terminals including at least one ground terminal, the ground terminal being formed by blanking a sheet metal, and a plate surface of the ground terminal being arranged in a vertical direction; and at least one grounding elastic piece formed by blanking a sheet metal, a plate surface of the grounding elastic piece and the plate surface of the ground terminal being located within a same plane in the vertical direction and are connected electrically to each other, and a conducting portion being formed on a cutting surface of the grounding elastic piece, and the conducting portion being in contact with the metal shell in the vertical direction to form grounding, a latch member, comprising a connecting portion and two locking arms located at both sides of the connecting portion and connected electrically to the connecting portion, wherein the two locking arms are located on both sides of the mating portion and each provided with a locking portion, and each of the locking portions extends into the mating slot to engage with a buckling slot of a tongue of a mating socket connector.

2. The plug connector of claim 1, wherein the insulating body is provided with a plurality of terminal slots respectively receiving the terminals, the ground terminal has a fixing portion and a first tail portion extending backward from the fixing portion, the fixing portion is retained in the terminal slot, and the grounding elastic piece is formed by extending out of the insulating body from one of upper and lower opposite sides of the first tail portion.

3. The plug connector of claim 2, wherein the grounding elastic piece has a vertical arm connected to the first tail portion and a horizontal arm extending forward from the first vertical arm, and an arc-shaped conducting portion is protruded outward from a cutting surface of the horizontal arm and is in contact with an internal wall surface of the metal shell.

4. The plug connector of claim 3, wherein the insulating body is provided with a limiting slot to retain the horizontal arm, a partition is arranged between the limiting slot and corresponding one of the terminal slots to limit the horizontal arm from excessive deformation, and the limiting slot and the corresponding one of the terminal slots communicate with each other in the vertical direction at a rear end position of the insulating body.

5. The plug connector of claim 3, wherein at least one of upper and lower opposite sides of the fixing portion is provided with a protruding portion, the protruding portion is in interference fit with the terminal slot, and is located in front of the horizontal arm.

6. The plug connector of claim 2, wherein the first tail portion is suspended in the terminal slot.

7. The plug connector of claim 2, wherein the first tail portion is provided with an opening recessed forward from a rear edge thereof, and two clamping arms are respectively formed on upper and lower sides of the opening to elastically urge against the connecting portion in the vertical direction.

8. The plug connector of claim 7, wherein each of the clamping arms is provided with a protrusion protruded into the opening to urge against the connecting portion.

9. The plug connector of claim 2, wherein the first tail portion is provided with an opening recessed forward from a rear edge thereof and running through an upper edge or a lower edge of the first tail portion, and the first tail portion elastically urges against the connecting portion in the vertical direction.

10. The plug connector of claim 2, wherein the at least one ground terminal comprises two ground terminals symmetrically arranged in a left-right direction of the insulating body, each of the ground terminals comprises two contacting arms extending forward from the fixing portion, each of the contacting arms is provided with a contacting portion, the contacting portions of each of the ground terminals are aligned in the vertical direction and arranged on the upper and lower opposite sides of the mating slot.

11. The plug connector of claim 2, wherein a first soldering portion extends from the connecting portion, is exposed out of a rear end of the insulating body, and is used for being soldered with a ground wire, and the first tail portion is connected electrically to the ground wire through the first soldering portion.

12. The plug connector of claim 11, wherein the locking arms and the first soldering portion are located within the same plane.

13. The plug connector of claim 11, wherein the terminals further include at least one power terminal and a detecting terminal, the power terminal comprises a second soldering portion exposed out of the rear end of the insulating body, the detecting terminal comprises a third soldering portion exposed out of the rear end of the insulating body, and the first, second and third soldering portions are located within planes at different heights in the vertical direction.

14. The plug connector of claim 2, wherein the terminals include two ground terminals and further include two power terminals symmetrically arranged in a left-right direction, the two power terminals are located between the two ground terminals, each of the two power terminals comprises a second tail portion suspended in the terminal slot, and each of the second tail portions extends backward and crosses over the connecting portion to form a second soldering portion.

15. The plug connector of claim 2, wherein each of two sides of the mating portion is provided with an open slot to receive corresponding one of the locking arms, and two protruding ribs are respectively arranged convexly above and below each of the open slots on an outer surface of the mating portion, and the protruding ribs are in interference fit with the metal shell.

16. A plug connector, comprising:

a metal shell;

an insulating body accommodated in the metal shell, a front end of the insulating body being provided with a mating portion, and the mating portion being recessed from front to back to form a mating slot;

a plurality of terminals having a plurality of contacting portions, the contacting portions being respectively arranged in a row on upper and lower opposite sides of the mating slot, the terminals including at least one ground terminal, the ground terminal being formed by blanking a sheet metal, and a plate surface of the ground terminal being arranged in a vertical direction; and at least one grounding elastic piece, formed by blanking a sheet metal, a plate surface of the grounding elastic piece and the plate surface of the ground terminal being arranged in parallel and being connected electrically to each other, and a conducting portion being formed on a cutting surface of the grounding elastic piece, and the conducting portion being in contact with the metal shell in the vertical direction to form grounding, a latch member, comprising a connecting portion and two locking arms located at both sides of the connecting portion and connected electrically to the connecting portion, wherein the two locking arms are located on both sides of the mating portion and each provided with a locking portion, and each of the locking portions extends into the mating slot to engage with a buckling slot of a tongue of a mating socket connector.

17. The plug connector of claim 16, wherein the insulating body is provided with a plurality of terminal slots respectively receiving the terminals, the ground terminal has a fixing portion and a first tail portion extending backward from the fixing portion, the fixing portion is retained in the terminal slot, and the grounding elastic piece is connected electrically to the ground terminal at the first tail portion.

18. The plug connector of claim 17, wherein the grounding elastic piece is formed by extending out of the insulating body from one of upper and lower opposite sides of the first tail portion, and the plate surface of the grounding elastic piece and the plate surface of the ground terminal are located within a same vertical plane.

19. The plug connector of claim 17, wherein a bending portion is connected between the grounding elastic piece and the first tail portion, and the bending portion makes the plate surface of the grounding elastic piece and the plate surface of the ground terminal be located within different vertical planes.

20. The plug connector of claim 17, wherein the first tail portion is suspended in the terminal slot.

21. The plug connector of claim 17, wherein the first tail portion is provided with an opening recessed forward from a rear edge of the first tail portion, and two clamping arms are respectively formed on upper and lower sides of the opening to elastically urge against the connecting portion in the vertical direction.

22. The plug connector of claim 21, wherein each of the clamping arms is provided with a protrusion protruded into the opening to urge against the connecting portion.

23. The plug connector of claim 17, wherein the first tail portion is provided with an opening recessed forward from a rear edge thereof and running through an upper edge or a lower edge of the first tail portion, and the first tail portion elastically urges against the connecting portion in the vertical direction.

24. The plug connector of claim 17, wherein there are two ground terminals arranged symmetrically on left-right direction of the insulating body, each of the ground terminals comprises two contacting arms extending forward from the fixing portion, each of the two contacting arms is provided with a contacting portion, the contacting portions of each of the ground terminals are aligned in the vertical direction and arranged on the upper and lower opposite sides of the mating slot.

25. The plug connector of claim 17, wherein a first soldering portion extends from the connecting portion, is exposed out of a rear end of the insulating body, and is used for being soldered with a ground wire, and the first tail portion is connected electrically to the ground wire through the first soldering portion.

26. The plug connector of claim 25, wherein the locking arms and the first soldering portion are located within the same plane.

27. The plug connector of claim 25, wherein the terminals further include at least one power terminal and a detecting terminal, the power terminal comprises a second soldering portion exposed out of the rear end of the insulating body, the detecting terminal comprises a third soldering portion exposed out of the rear end of the insulating body, and the first, second and third soldering portions are located within planes at different heights in the vertical direction.

28. The plug connector of claim 17, wherein the terminals include two ground terminals and further include two power terminals arranged symmetrically on left-right direction, the two power terminals are located between the two ground terminals, each of the two power terminals comprises a second tail portion suspended in the terminal slot, and each of the second tail portions extends backward and crosses over the connecting portion to form a second soldering portion.

29. The plug connector of claim 17, wherein each of two sides of the mating portion is provided with an open slot to receive corresponding one of the locking arms, and two protruding ribs are respectively arranged convexly above and below each of the open slots on an outer surface of the mating portion, and the protruding ribs are in interference fit with the metal shell.

* * * * *